United States Patent [19]

Ulrich

[11] 4,065,091

[45] Dec. 27, 1977

[54] PICTURE FRAME SUPPORT

[75] Inventor: John Ulrich, Chicago, Ill.

[73] Assignee: Nu-Dell Plastics Corporation, Chicago, Ill.

[21] Appl. No.: 750,284

[22] Filed: Dec. 13, 1976

[51] Int. Cl.[2] ..... A47F 7/14

[52] U.S. Cl. ..... 248/473; 248/488

[58] Field of Search ..... 248/473, 346, 488, 454, 248/455; 40/125 H, 152.1, 120, 11; 403/364, 339, 341

[56] References Cited

U.S. PATENT DOCUMENTS

| | | | |
|---|---|---|---|
| 1,247,938 | 11/1917 | Curtenius | 403/364 |
| 1,719,504 | 7/1929 | Egan | 40/11 R |
| 3,280,492 | 10/1966 | Nichols | 40/152.1 |

FOREIGN PATENT DOCUMENTS

| | | | |
|---|---|---|---|
| 906,587 | 5/1945 | France | 248/473 |
| 172,535 | 12/1921 | United Kingdom | 40/11 R |

*Primary Examiner*—Robert Hafer

*Attorney, Agent, or Firm*—Edward C. Threedy

[57] ABSTRACT

A stand for holding a picture frame in a substantially vertically inclined viewing position including a base providing forwardly projecting side leg members upon which a corresponding flange of the picture frame is adapted to sit, with the stand providing locking tabs extending in spaced parallel relation to, but inwardly of, the side leg members for restraining engagement with the opposite side face of the picture frame flange so as to support the same thereon.

6 Claims, 6 Drawing Figures

PICTURE FRAME SUPPORT

SUMMARY OF THE INVENTION

A stand for a frame that provides a peripheral flange extending about a picture or display therein. The stand provides cliplike members cooperating with supporting legs for the stand for frictionally engaging a portion of the peripheral flange of the frame for supporting the same in a substantially vertically inclined position for viewing.

The stand is preferably manufactured as a one-piece molded unit formed from a suitable plastic material. Thus, it is light-weight but provides the required rigidity and strength for its intended use.

GENERAL DESCRIPTION

The invention will be best understood by reference to the accompanying drawings showing the preferred form of construction, and in which.

Figure 1:
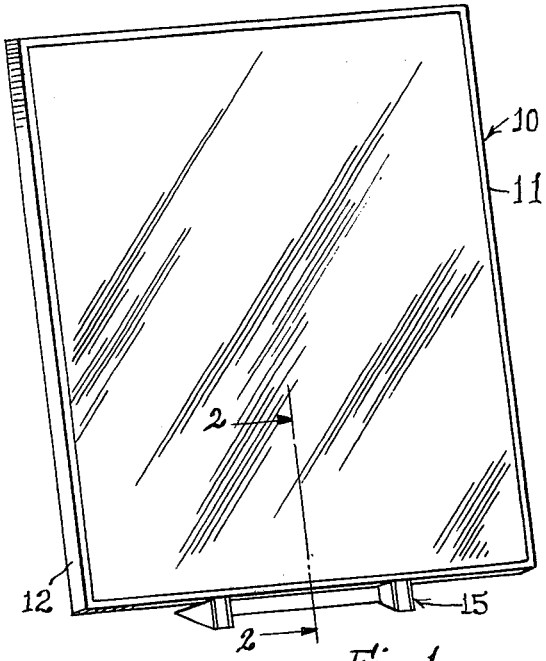
FIG. 1 is a perspective view of the stand and picture frame.

The stand of this invention is adapted to be used with a picture frame 10 that provides a transparent viewing face 11 surrounded by a peripheral flange 12. Within the frame 10 is a backing 13 which not only holds the picture or display 14 against the viewing face 11 of the frame 10, but also substantially fills the area defined by the peripheral flange 12, such as shown in FIG. 2.

Figure 6:
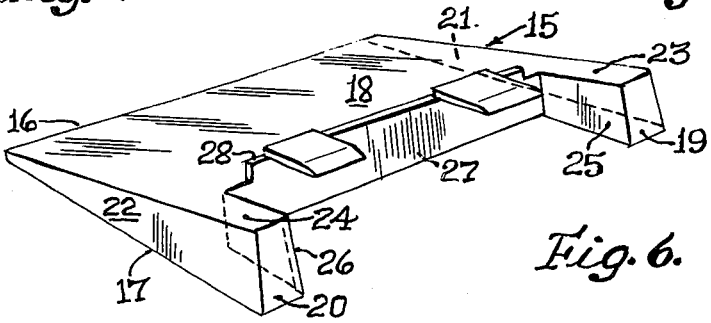
FIG. 6 is a perspective view of the stand.

Referring to FIG. 6, there is shown the stand 15. This stand 15 consists of a base support 16, which is substantially triangular in cross section so as to present horizontal bottom edge surfaces 17 as well as an inclined upper face 18. From the base support 16 there is provided a pair of forwardly projecting leg members 19 and 20 formed from continuous opposite side walls 21 and 22 of the base support 16. Each of the forwardly projecting leg members 19 and 20 provides substantially flat frame-supporting surfaces 23 and 24, which are a continuation of the inclined upper face 18 of the base support 16. The inner side edges 25 and 26 of the leg members 19 and 20 terminate into a rear wall 27, which has a portion 28 projecting above the inclined upper face 18 of the base support 16. This raised portion 28 of the wall 27 supports forwardly projecting locking tabs 29 and 30, which are adapted to extend in a substantially parallel direction with respect to the flat frame-supporting surfaces 23 and 24 of each of the leg members 19 and 20.

Figure 2:
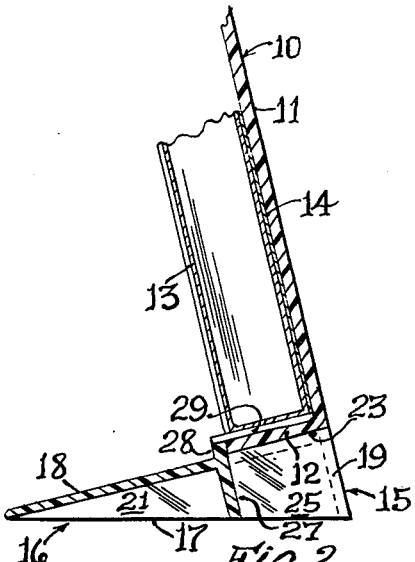
FIG. 2 is a fragmentary detailed sectional view taken on line 2—2 of FIG. 1.
Figure 3:
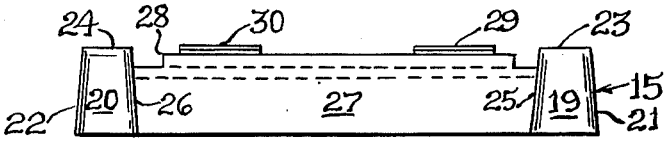
FIG. 3 is a front elevational view of the stand.
Figure 4:
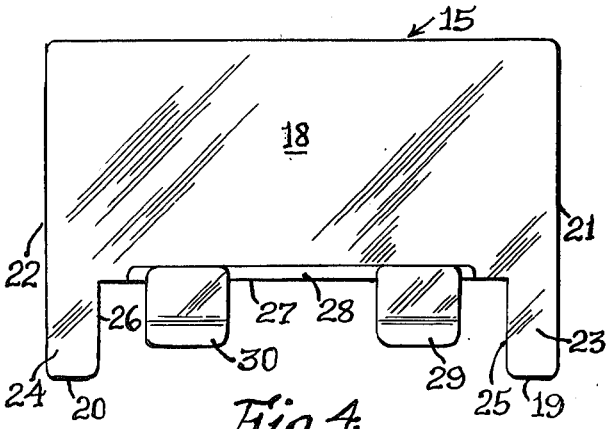
FIG. 4 is a top plan view of the picture frame stand.
Figure 5:
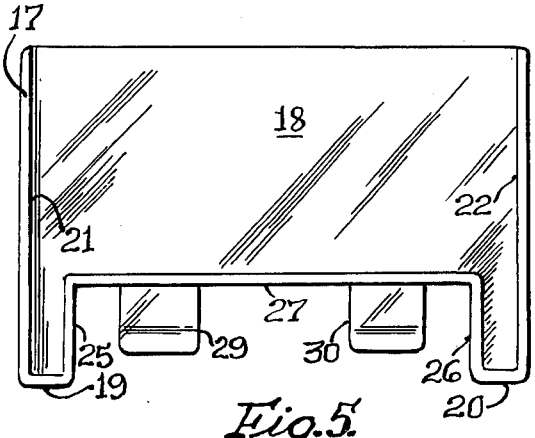
FIG. 5 is a bottom plan view of the picture frame stand.

In use and as shown in FIGS. 1 and 2, the bottom peripheral flange 12 of the frame 10 is placed upon the substantially flat frame-supporting surfaces 23 and 24 of the leg members 19 and 20 and is slid rearwardly and downwardly thereon until it passes beneath the locking tabs 29 and 30. As shown in FIG. 2, these locking tabs 29 and 30 will then cooperate with the leg members 19 and 20 to frictionally hold the picture frame 10 in a vertically inclined viewing position, as shown.

By this construction, the frame may be readily removed from the stand for cleaning or replacement as necessary, without destruction of any of the structural components of either the frame or the stand, and, thus, both are adapted for reuse for their intended purpose.

While I have illustrated and described the preferred form of construction for carrying my invention into effect, this is capable of variation and modification without departing from the spirit of the invention. I, therefore, do not wish to be limited to the precise details of construction set forth but desire to avail myself of such variations and modifications as come within the scope of the appended claims.

Having thus described my invention, what I claim as new and desire to protect by Letters Patent is:

1. A combination picture frame and stand therefor comprising a. an open-back rectangularly shaped frame having a transparent face defined by a laterally extending peripheral flange, b. a base support substantially triangular in cross section presenting horizontal bottom edge surfaces and an inclined upper face, c. forwardly projecting leg members formed from opposite side walls of said base support providing continuous horizontal bottom edge surfaces and substantially flat frame-supporting surfaces extending coplanar with said inclined upper face of said base support, d. means extending in a spaced parallel relation to said leg members of said base cooperating with said frame-supporting surfaces for frictionally holding a portion of said peripheral flange of said frame thereon so as to support said transparent face of said frame vertically from said inclined upper face of said base.

2. A stand for a picture frame as defined by claim 1, wherein said means for frictionally holding a portion of the peripheral flange of the frame comprises locking tabs projecting in an elevated spaced parallel relation to said substantially flat frame-supporting surfaces of said forwardly projecting leg members.

3. A stand for a picture frame as defined by claim 1 and including means extending vertically between said forwardly projecting leg members for supporting said holding means and positioning the peripheral flange of the frame between said flat frame-supporting surfaces of said leg members and said holding means so as to support the frame in a vertically inclined viewing position.

4. A stand for a picture frame as defined by claim 2 and including means extending vertically between said leg members for supporting said locking tabs and positioning the peripheral flange of the frame between said locking tabs and said flat frame-supporting surfaces of said leg members so as to support the frame in a vertically inclined viewing position.

5. A stand for a picture frame as defined by claim 3, wherein said means extending vertically between said leg members comprises a wall abutment extending perpendicular to the inclned upper face of said base support between said forwardly projecting leg members.

6. A stand for a picture frame as defined by claim 2, wherein said means extending vertically between said leg members comprises a wall abutment extending perpendicular to the inclined upper face of said base support between said forwardly projecting leg members and supports said locking tabs and positions the peripheral flange of the frame between said locking tabs and said flat frame-supporting surfaces of said leg members so as to support the frame in a vertically inclined viewing position.

* * * * *